US008197577B2

(12) United States Patent
Couch

(10) Patent No.: US 8,197,577 B2
(45) Date of Patent: Jun. 12, 2012

(54) SYSTEM AND METHOD FOR UNDERWATER OIL AND GAS SEPARATOR

(75) Inventor: W. Jack Couch, Patterson, LA (US)

(73) Assignee: Oceaneering International, Inc., Houston, TX (US)

( * ) Notice: Subject to any disclaimer, the term of this patent is extended or adjusted under 35 U.S.C. 154(b) by 260 days.

(21) Appl. No.: 12/538,226

(22) Filed: Aug. 10, 2009

(65) Prior Publication Data

US 2010/0038324 A1 Feb. 18, 2010

Related U.S. Application Data

(60) Provisional application No. 61/088,182, filed on Aug. 12, 2008.

(51) Int. Cl.
*B01D 19/00* (2006.01)

(52) U.S. Cl. ..... 95/262; 96/204; 210/923; 405/60; 166/357; 166/368

(58) Field of Classification Search ..... 95/262, 95/260, 253; 96/204, 220, 183, 182; 210/923; 405/60; 166/357, 368
See application file for complete search history.

(56) References Cited

U.S. PATENT DOCUMENTS

| | | | | |
|---|---|---|---|---|
| 4,424,068 | A * | 1/1984 | McMillan | 95/243 |
| 4,440,523 | A * | 4/1984 | Milgram et al. | 210/170.11 |
| 4,447,247 | A * | 5/1984 | Naess | 95/253 |
| 4,456,071 | A * | 6/1984 | Milgram | 166/356 |
| 4,531,860 | A * | 7/1985 | Barnett | 405/60 |
| 5,213,444 | A * | 5/1993 | Henning | 405/63 |
| 2005/0025574 | A1 * | 2/2005 | Lazes | 405/60 |

FOREIGN PATENT DOCUMENTS

GB 2063776 A * 6/1981

* cited by examiner

*Primary Examiner* — Duane Smith
*Assistant Examiner* — Douglas Theisen
(74) *Attorney, Agent, or Firm* — Gary R. Maze; Berenbaum Weinshienk PC

(57) ABSTRACT

A passive hydrocarbon containment system for containing hydrocarbons in a fluid comprises a subsea separator dome, an oil pathway in fluid communication with a hydrocarbon collector disposed within the collection dome, and a gas outlet pipe having a discharge height dimensioned and adapted in relation to the height of the oil pathway sufficient to keep a portion of the oil pathway submerged into a fluid such as seawater present in the collection dome interior void. The hydrocarbon containment system can be moored subsea and used to collect oil and gas coming out of the ocean floor. One advantage of the hydrocarbon containment system is that there are no moving parts. A further advantage is that the hydrocarbon containment system requires limited maintenance to pump out the collected oil as needed.

14 Claims, 3 Drawing Sheets

SYSTEM AND METHOD FOR UNDERWATER OIL AND GAS SEPARATOR

RELATION TO OTHER APPLICATIONS

This application relates to and claims priority from U.S. Provisional Application 61/088,182.

FIELD OF THE INVENTION

Recovery of oil and/or gas subsea, especially from hurricane downed structures with leaking production wells. In its preferred embodiment, the separator works best with an oil and gas leak. Although currently contemplated embodiments also work with oil-only leaks, such would typically require an almost vertical placement to the domes used to capture the leaking production.

BACKGROUND OF THE INVENTION

Downed platform and submerged hydrocarbon conduits can become victim to uncontrolled oil and gas leaks. For example, platforms toppled by hurricanes can have multiple wells leaking oil and gas, creating an oil sheen on the surface and polluting exposed shorelines. Current oil and gas separation is performed on the water's surface using support vessels with separator equipment, or skimmer vessels, and/or cleaning crews to remove leaked oil from beaches. Surface vessels typically have separation units and recover the oil from the surface once it creates a sufficient sheen. Typically, a flare tower is not needed as the depth from which the gas is venting does not allow visible gas bubbles to show on the surface.

Collection domes can be used to effectively collect the leaking oil and gas streams, but, as the water depth (e.g., over 100 fsw) and distance from other fixed structures increase, the ability to separate the collected oil and gas from the leaking wells becomes a challenge requiring a topside support vessel. Further, subsea installation avoids topside support vessels which may or may not be able to stay on location in bad weather.

DETAILED DESCRIPTION OF PREFERRED EMBODIMENTS

Figure 1:
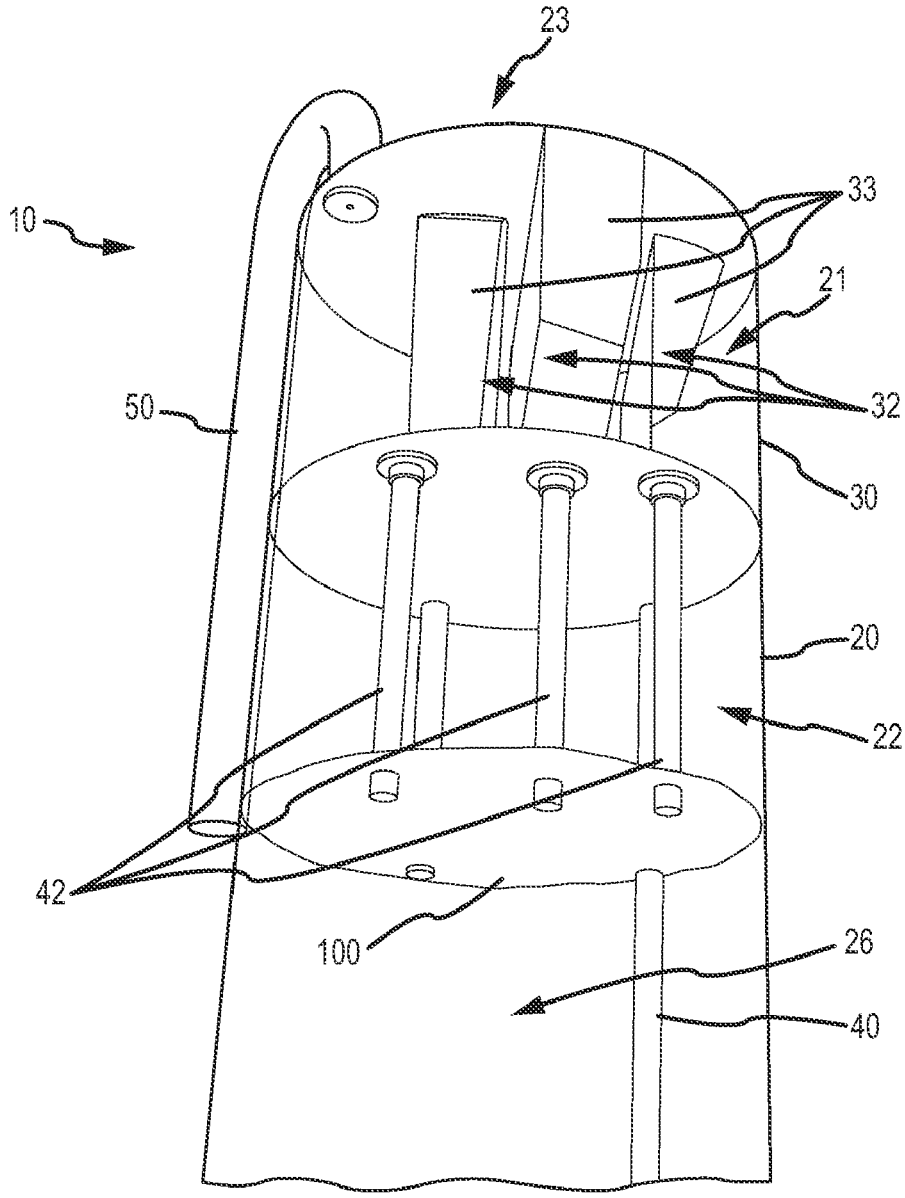
FIG. 1 is a view in partial cutaway perspective of a currently envisioned embodiment.

Referring now to FIG. 1, hydrocarbon containment separator system 10 can be moored subsea and used to collect oil and gas coming out of the ocean floor. Hydrocarbon containment separator system 10 comprises separator lower area 20 which comprises a collected hydrocarbon storage area; hydrocarbon separator upper portion 30, which may act as a hydrocarbon collector, disposed in upper portion of separator interior void 21; oil pathway 40 in fluid communication with separator upper portion 30, where oil pathway 40 is disposed within separator interior void 21 and has a predetermined height; one or more oil drainage pathways 42; and gas outlet pipe 50, which may act as a vent, having a discharge height dimensioned and adapted in relation to the height of oil drainage pathway 42 sufficient to keep a portion of oil drainage pathway 42 submerged into fluid 100 present in storage interior void 26. As used herein, "hydrocarbon containment system" is synonymous with a separator, as it is used to collect oil and gas coming out of the ocean floor and separate the two, and may comprise a substantially cylindrical or dome shape.

Separator lower area 20 comprises separator interior void 22, and storage interior void 26, which comprises a substantially open lower end. Separator lower area 20 may be in a substantially cylindrical shape.

In certain embodiments, separator upper portion 30 further comprises one or more baffles 32 which comprise one or more baffle plates 33. Baffle 32 may be angled at a predetermined angle. In an embodiment, baffle 32, e.g. its baffle plates 33, are angled. In other embodiments, a surface area may be added, e.g. in between baffle 32 and inlet areas defined by oil pathway 40, to give an additional surface to which oil may adhere.

Figure 3:
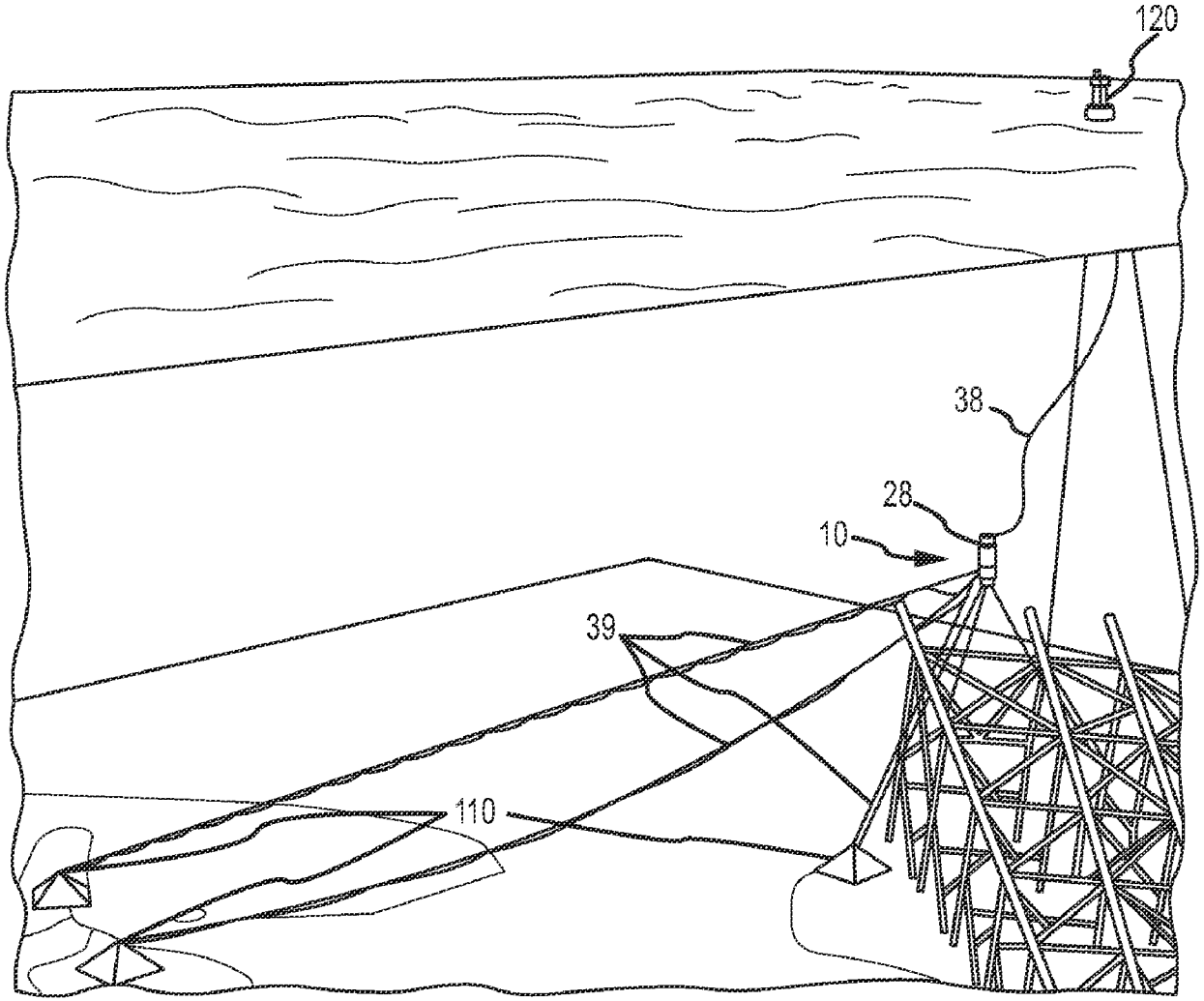
FIG. 3 is a view in further partial perspective of an exemplary deployment.

Referring additionally to FIG. 3, hydrocarbon containment separator system 10 may further comprise buoyancy collar 28 integrated into and/or attached to hydrocarbon containment separator system 10 and used to control depth of hydrocarbon containment system 10 in the water column. Ocean floor mounted units would typically not need buoyancy collar 28 which may be used raise hydrocarbon containment separator system 10 to allow proper upward flow such as using hoses 39 from collection domes 110.

One advantage of hydrocarbon containment separator system 10 is that there are no moving parts. A further advantage is that hydrocarbon containment separator system 10 requires limited maintenance to pump out the collected oil as needed.

In the operation of a preferred embodiment, referring to FIG. 1 and generally to FIG. 3, hydrocarbon containment separator system 10 is used as a subsea oil and gas separator which can be installed underwater to collect oil and gas, e.g. from downed platforms, natural seepage and damaged pipelines. The collected oil and/or gas can be collected, e.g. in collection domes 110, and directed into hydrocarbon containment separator system 10 such as using hoses 39. In an embodiment, hydrocarbon containment separator system 10 removes the oil from the gas, contains the oil, and vents the gas.

Once inside separator upper area 30, the oil will be separated and gravitate down into separator lower area 20 while the gas may be vented back into the sea water by gas outlet pipe 50.

Multiple hydrocarbons discharges may be contained underwater by locating a source of leaking hydrocarbons, typically a broken pipeline or wellhead device; collecting the leaking hydrocarbons using one or more collection domes 110 (FIG. 3); and piping the collected hydrocarbons to hydrocarbon containment separator system 10 with hoses 39 using a fluid such as seawater. Hose 39 typically mates with a separator inlet pipe comprising oil pathway 40, allowing the hydrocarbons to enter into hydrocarbon containment separator system 10 through oil pathway 40.

The hydrocarbons in fluid 100 condense onto a collector such as baffle 32 and drain down hydrocarbon drains comprising one or more oil drainage pathways 42 and the gaseous component of the hydrocarbons flow out the gas vent comprising gas outlet pipe 50. For example, ambient seawater provides balancing pressures for hydrocarbon containment separator system 10, using the gas coming into separator lower area 20 to create the flow and maintain the gas envelope required in a separator lower area 20 so that gravity can help collect the oil, separate the oil and gas by flow through baffles 32, and let the collected material flow down into a separator storage area, defined by storage interior void 26, by passing down oil drainage pathway 42. Accordingly, stored hydrocarbon fluid 100 is allowed to partially enter into separator interior void 22 above lower ends of oil drainage pathway 42 such that a portion of oil drainage pathways 42 is submerged into stored hydrocarbon fluid 100 in separator interior void 22.

Gas outlet pipe 50, which is in fluid communication on the discharge side with the ambient sea water or other fluid and located proximate substantially closed upper end 23, and gas outlet pipe 50 disposed outside separator lower 20 may be present, as in the preferred embodiment. In this embodiment, the gas component present in separator interior void 22 exits separator interior void 21 through gas outlet pipe 50 and is vented to ambient sea water or fluid through gas outlet pipe 50. The discharge end of gas outlet pipe 50 is positioned at a height relative to separator interior void 22 sufficient to control the level of hydrocarbon fluid 100 within separator lower area 20. Moreover, gas outlet pipe 50 may be dimensioned such that its discharge height, in relation to the length of oil drainage pathway 42, is sufficient to keep a portion of oil drainage pathway 42 submerged into hydrocarbon fluid 100 present in separator interior void 22.

Figure 2:
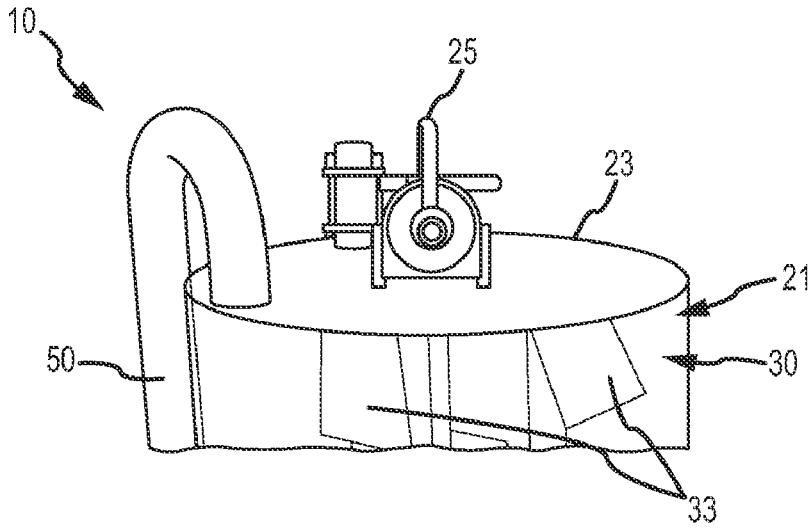
FIG. 2 is a view in further partial perspective of a top portion of a currently envisioned embodiment.

Hydrocarbon containment separator system 10 may be positioned using gravity, a remotely operated vehicle (ROV) (not shown in the figures), or the like, or a combination thereof. Additionally, buoyancy collar 28 (FIG. 3) may be integrated into and/or attached to separator lower area 20 and used to control a depth of separator lower area 20 in fluid. By way of example and not limitation, hydrocarbon containment separator system 10 may be moored, e.g. to an underwater device such as a wellhead or pipeline, to achieve a predetermined location relative to the source of hydrocarbons in fluid. Such mooring may be secured to allowing hydrocarbon containment separator system 10 to use buoyancy, either a natural buoyancy or buoyancy created or augmented by buoyancy collar 28, to float mid-water, by anchoring hydrocarbon containment separator system 10 to a suction pile, by attaching hydrocarbon containment separator system 10 to a fixed subsea structure, or the like, or a combination thereof. Surface buoy 120 may be tethered to hydrocarbon containment system 10 such as by connector 38 and terminus 25 (FIG. 2).

Strategically placing the gas outlet pipe 50 discharge height in relation to the height of oil drainage pathway 42 keeps the drain outlets of oil drainage pathway 42 under the fluid levels of hydrocarbon fluid 100 and prevents gas flow bypassing the flow path through baffles 32. The whole separation process is completed without any moving parts.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A hydrocarbon containment separator system, comprising:

a) a subsea separator interior void, the subsea separator interior void further comprising a hydrocarbon separator storage interior void;

b) a substantially closed upper end, c) a substantially open lower end;

d) a hydrocarbon separator upper portion disposed in an upper portion of the subsea separator interior void;

e) an oil pathway in fluid communication with the hydrocarbon separator storage area, the oil pathway disposed within the interior void and having a height, the oil pathway comprising an oil drainage pathway; and f) a gas outlet pipe having a discharge height dimensioned and adapted in relation to the height of the oil pathway sufficient to keep a portion of the oil pathway submerged into the fluid present in the interior void.

2. The hydrocarbon containment separator system of claim 1, wherein the separator upper portion further comprises a baffle.

3. The hydrocarbon containment separator system of claim 2, wherein the baffle comprises a baffle plate.

4. The hydrocarbon containment separator system of claim 2, wherein the baffle is angled at a predetermined angle.

5. The hydrocarbon containment separator system of claim 1, further comprising a buoyancy collar attached to the substantially closed upper end.

6. The hydrocarbon containment separator system of claim 5, wherein the buoyancy collar is integrated into the substantially closed upper end.

7. A method of containing hydrocarbons underwater, comprising:

g) locating a source of hydrocarbons in a fluid, the hydrocarbons comprising a gaseous component and a non-gaseous component;

h) positioning a hydrocarbon containment system proximate the source sufficient to allow the hydrocarbons to enter into the containment system, the hydrocarbon containment system comprising:

i) a separator dome comprising an interior void, a substantially closed upper end, and a substantially open lower end, the interior void further comprising an interior storage area;

ii) a hydrocarbon separator disposed in an upper portion of the separator dome interior void; and iii) an oil drainage pathway in fluid communication with the hydrocarbon separator, the oil drainage pathway disposed within the separator dome interior void and dimensioned and adapted to extend a predetermined distance towards the separator dome lower end;

i) allowing the fluid to enter into the separator dome interior void through the lower end such that a portion of the oil drainage pathway is submerged into the fluid in the separator dome interior void;

j) allowing the hydrocarbons in the fluid to condense onto the hydrocarbon separator;

k) allowing the non-gaseous component of the hydrocarbons to collect on the oil drainage pathway; and l) allowing gravity to return the non-gaseous component of the hydrocarbons to the fluid in the separator dome interior storage area.

8. The method of containing hydrocarbons underwater of claim 7, further comprising:

m) providing a gas outlet pipe, the gas outlet pipe comprising (i) a gas inlet port in fluid communication with the separator dome interior void and disposed proximate the substantially closed upper end and (ii) an gas outlet port disposed outside the separator dome; and n) allowing the gas component present in the upper portion of the separator dome interior void to exit the separator dome interior void through the gas outlet port.

9. The method of claim 8, further comprising positioning the gas outlet port at a height relative to the separator dome sufficient to control the level of fluid within the separator dome.

10. The method of claim 8, wherein the gas outlet pipe discharge height is dimensioned in relation to the height of the oil drainage pathway sufficient to keep a portion of the oil drainage pathway submerged into the fluid present in the separator dome interior void.

11. The method of claim 7, wherein the fluid is seawater.

12. The method of claim 7, further comprising:

o) attaching a buoyancy collar to the separator dome; and p) using the buoyancy collar to control a depth of the separator dome in the fluid.

13. The method of claim 7, further comprising mooring the separator dome to achieve a predetermined location relative to the source of hydrocarbons in a fluid.

14. The method of claim 13, wherein the mooring is at least one of floating mid-water, anchoring the separator dome to a suction pile, or attaching the separator dome to fixed subsea structure.

* * * * *